US009687710B2

(12) United States Patent
Keith

(10) Patent No.: US 9,687,710 B2
(45) Date of Patent: Jun. 27, 2017

(54) FOOTBALL TRAINING DEVICE

(71) Applicant: Richard Arthur Keith, Grass Lake, MI (US)

(72) Inventor: Richard Arthur Keith, Grass Lake, MI (US)

(73) Assignee: Allan Wendling, New Lothrop, MI (US)

( * ) Notice: Subject to any disclaimer, the term of this patent is extended or adjusted under 35 U.S.C. 154(b) by 0 days.

(21) Appl. No.: 14/955,169

(22) Filed: Dec. 1, 2015

(65) Prior Publication Data

US 2016/0151693 A1 Jun. 2, 2016

Related U.S. Application Data

(60) Provisional application No. 62/086,239, filed on Dec. 2, 2014.

(51) Int. Cl.

| | |
|---|---|
| ***A63B 69/00*** | (2006.01) |
| ***A63B 41/00*** | (2006.01) |
| ***A63B 43/00*** | (2006.01) |
| ***A63B 43/02*** | (2006.01) |
| *A63B 69/38* | (2006.01) |

(52) U.S. Cl.

CPC ..... *A63B 69/00* (2013.01); *A63B 41/00* (2013.01); *A63B 43/007* (2013.01); *A63B 43/02* (2013.01); *A63B 69/0002* (2013.01); *A63B 69/0079* (2013.01); *A63B 69/0088* (2013.01); *A63B 69/38* (2013.01); *A63B 2243/007* (2013.01)

(58) Field of Classification Search

CPC . A63B 69/0002; A63B 69/38; A63B 69/0079; A63B 69/0088; A63B 2243/007; A63B 69/00; A63B 43/02; A63B 43/007; A63B 41/00

USPC ..... 473/438, 422, 423–430

See application file for complete search history.

(56) References Cited

U.S. PATENT DOCUMENTS

| | | | | | |
|---|---|---|---|---|---|
| 2,898,610 | A | * | 8/1959 | Chamberlain | B63C 9/155 441/114 |
| 3,042,404 | A | * | 7/1962 | Masters | A63B 69/0086 473/424 |
| 3,227,450 | A | * | 1/1966 | Pruitt | A63B 69/0084 473/426 |
| 3,804,409 | A | * | 4/1974 | Schachner | A63B 69/0079 473/423 |
| 3,940,133 | A | * | 2/1976 | Civita | A63B 69/0086 473/424 |
| 4,350,338 | A | * | 9/1982 | May | A63B 69/0079 473/423 |
| 5,031,910 | A | * | 7/1991 | Kopp | A63B 69/0079 473/423 |
| 5,611,532 | A | * | 3/1997 | Forrest, Sr. | A63B 43/00 473/576 |
| 5,611,540 | A | * | 3/1997 | Williams | A63B 69/0079 473/429 |
| 5,772,542 | A | * | 6/1998 | Gildea | A63B 43/007 473/576 |

(Continued)

*Primary Examiner* — Mitra Aryanpour

(74) *Attorney, Agent, or Firm* — Dinsmore & Shohl LLP

(57) ABSTRACT

A football training device in which an elongated strap is attached to a football. The strap is elastic and has a handgrip formed at its other end. In practice, a ball runner carries the football while a trainer pulls on the strap in an effort to simulate a fumble thus improving the manner in which the ball carrier carries the ball.

7 Claims, 2 Drawing Sheets

(56) References Cited

U.S. PATENT DOCUMENTS

| | | | | |
|---|---|---|---|---|
| 5,853,339 | A * | 12/1998 | Scerbo | A63B 69/0086 473/576 |
| 8,172,704 | B2 * | 5/2012 | Horkan | A63B 69/002 473/438 |
| 8,512,177 | B2 * | 8/2013 | Krysiak | A63B 41/02 473/570 |
| 2006/0183570 | A1 * | 8/2006 | Gamsaragan | A63B 69/0086 473/424 |
| 2011/0172033 | A1 * | 7/2011 | Horkan | A63B 69/002 473/438 |
| 2016/0151693 | A1 * | 6/2016 | Keith | A63B 69/0088 473/424 |

* cited by examiner

FOOTBALL TRAINING DEVICE

CROSS-REFERENCE TO RELATED APPLICATIONS

This application claims priority of U.S. Provisional Application No. 62/086,239 filed Dec. 2, 2014, the contents of which are incorporated herein by reference.

BACKGROUND OF THE INVENTION

I. Field of the Invention

The present invention relates generally to sport training devices and, more particularly, to a football nonfumble training device.

II. Description of Related Art

In the game of American football, the football runner or receiver carries the football and attempts to advance the football to his or her team's goal. The play is usually ended when the ball carrier is downed on the ground. The ball carrier becomes downed when his knees or other well-defined parts of his body contact the ground.

However, as long as the ball carrier has not been downed, the play is still in progress. During this time, the opposing team oftentimes attempts to cause the ball carrier to fumble the football prior to the end of the play. Indeed, many football players on the defensive team will attempt to strip the football from the ball carrier in order to create the fumble and such actions are not only perfectly acceptable, but promoted.

Consequently, from the perspective of the ball carrier, it is essential that the ball carrier remain in control of the football despite attempts by the opposing team to cause a fumble until the end of the play. While football coaches may explain and even demonstrate how to carry the ball in order to minimize the possibility of a fumble, there have been no previously known training devices that simulate the attempts by the defensive team to strip the ball from the ball carrier.

SUMMARY OF THE PRESENT INVENTION

The present invention provides a training device for carriers of the football which simulates attempts by the opposing team to create a fumble during play of the football game.

In brief, the football training device of the present invention comprises an elongated strap that is attached at one end to the football and has a handgrip at its other end. The strap is preferably elastic winch allows limited stretching of the strap. In use, a coach or football trainer will hold the end of the strap by the handgrip while running alongside or behind the ball carrier. As the ball carrier runs, the coach will tug on the strap, often repeatedly, to simulate attempts by the opposing team to cause a fumble by stripping the bail from the ball carrier.

The training device of the present invention thus teaches the ball carrier how to maintain control of the football despite attempts by the opposing team to cause a fumble.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a plan view illustrating a preferred embodiment of the present invention;

DETAILED DESCRIPTION OF PREFERRED EMBODIMENTS OF THE PRESENT INVENTION

Figure 2:
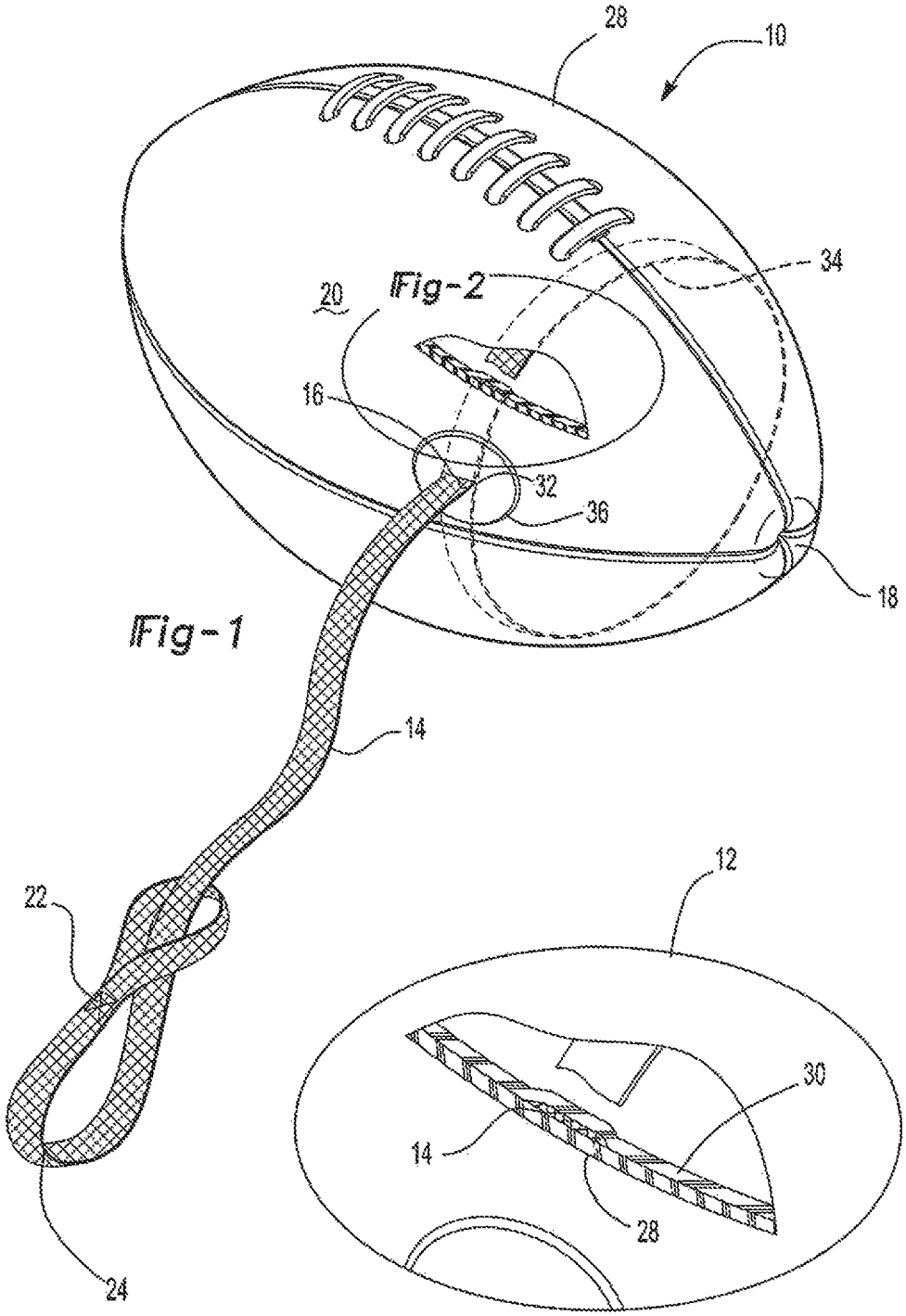
FIG. 2 is a partial sectional view of circle FIG. 2 in FIG. 1 and illustrating the attachment of the strap to the football.

With reference first to FIG. 1, a first preferred embodiment of the football training device 10 according to the present invention is shown. The football training device 10 includes a standard football 12 although other sizes, such as junior or youth size, ma be used without deviation from the spirit or scope of the invention.

An elongated strap 14 is connected at one end 16 to the football 12 at a point intermediate a nose 18 of the football 12 and a midpoint 20 of the football 12. The strap 14, furthermore, is made of an elastic material so that the strap 14 can undergo limited extension.

A handgrip 22 in the form of a loop is provided at the end 24 of the strap 14 opposite from the end 16 of the strap 14. This loop 22 is preferably formed by an end portion of the strap 14 and may be varied in size by simply sliding the strap through an adjustment loop 26. With reference now particularly to FIG. 2, the football 12 includes an outer cover 28, commonly called a pigskin, as well as an inflatable inner bladder 30. Once the bladder 30 is fully inflated, the outer surface of the bladder 30 is in abutment with the inner surface of the cover 28.

Referring to FIGS. 1 and 2, in the first embodiment of the invention, the strap 14 extends through an opening 32 formed in the cover 28 at a point intermediate the nose 18 and a midpoint 20 of the football 12. A loop 34 in the strap 14 then extends around the bladder 30 so that the loop is entrapped in between the bladder 30 and the cover 28. In doing so, the end 16 of the strap 14 is securely attached to the football 12.

In order to prevent tearing or ripping of the cover 28, a reinforcing grommet 36 is attached to the cover 28 around the opening 32. This reinforcing grommet 36 may be made of any suitable hard material, such as metal, hard plastic, and the like.

Figure 3:
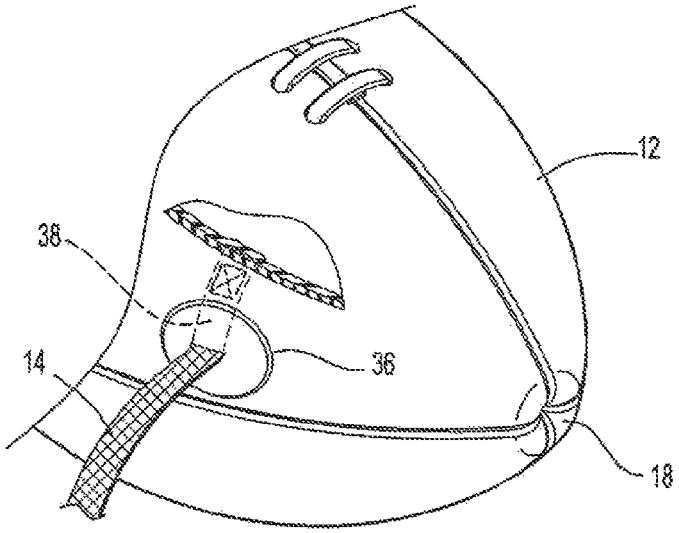
FIG. 3 is a view similar to FIG. 2, but illustrating a modification thereof.

With reference now to FIG. 3, an alternative method of attaching the strap 14 to the football 12 is shown. As before, one end 38 of the strap 14 extends through the opening 32 in the football cover 28. As before, a reinforcing grommet 36 is optionally provided around the opening 32 to protect the cover 28 of the football 12 from tearing.

Unlike the first embodiment of the invention, however, the portion 38 of the strap 14 inserted into the opening 32 is simply wrapped around the opening 32 so that the strap portion 38 is sandwiched in between the bladder 30 and the cover 28 adjacent the opening 32. This portion 38 of the strap 14 is then attached to the cover 28 by any conventional method, such as sewing 40, gluing, and the like.

Figure 4:
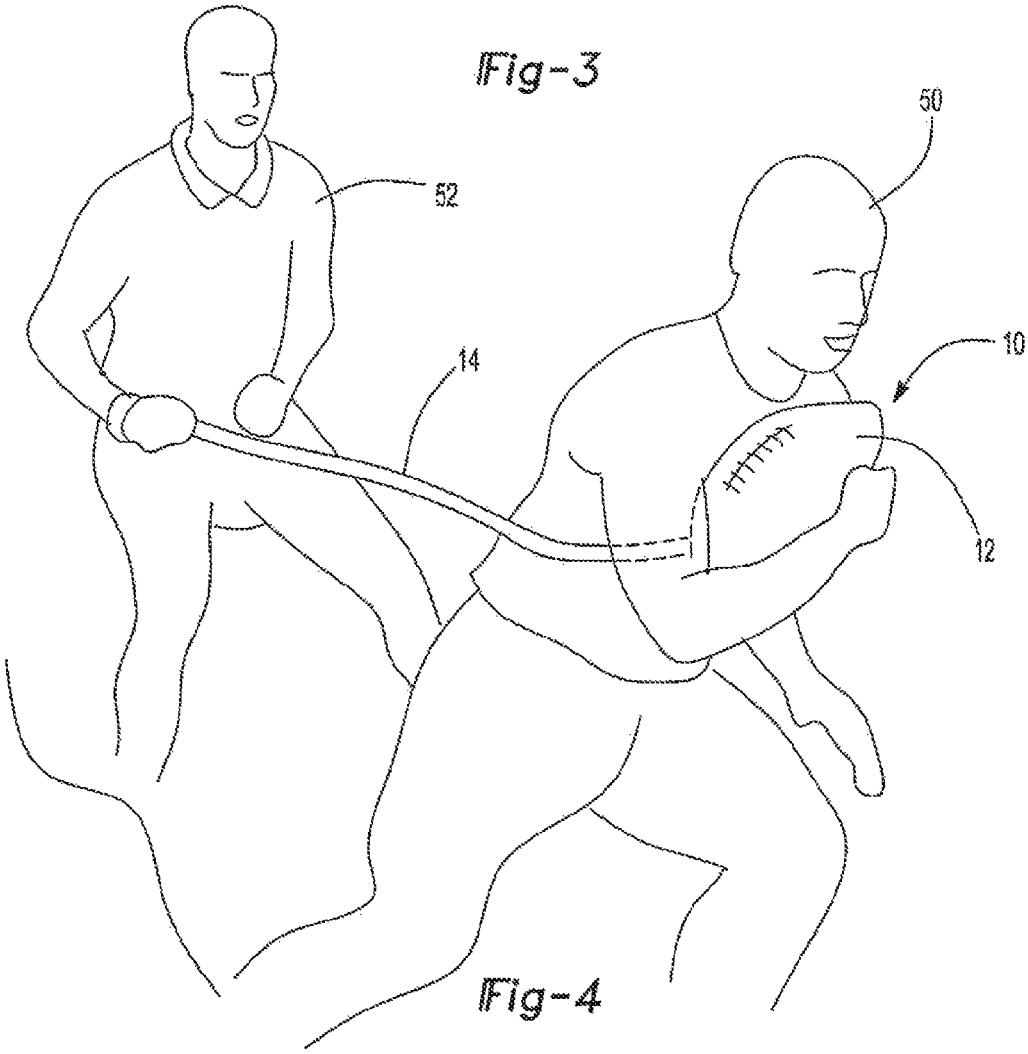
FIG. 4 is an elevational view illustrating the use of the training device of the present invention.

With reference now to FIG. 4, in use a football carrier 50 holds the football 12 in the normal fashion while the football carrier 50 runs in a forward direction. A football trainer 52 runs behind the football carrier 50 and repeatedly jerks the football 12 by the strap 14 to stimulate an attempt by a defensive player to strip the football 12 from the ball carrier 50.

Since the attachment between the strap 14 and the football 12 is at a point intermediate the nose 18 of the football and a midpoint 20 of the football, and preferably 3 to 4 inches from the nose 18, the football trainer 52 is able to apply a high amount of torque to the football by pulling on the strap 14. This type of torque closely approximates the forces applied by defensive players in their attempt to strip the football from the ball carrier 50. Consequently, by learning how to carry the ball 12 despite the yanks or tugs from the trainer 52 on the strap 14, the ball carrier 50 learns how to safely secure the football 12 and prevent or at least decrease fumbling.

Having described my invention, many modifications thereto will become apparent to those skilled in the art to which it pertains without deviation from the spirit of the invention as defined by the scope of the appended claims.

I claim:

1. A football training device comprising:

a football, and an elongated strap having one end attached to the football, wherein said football includes a bladder surrounded by a skin, wherein said one end of said strap is attached to said football at an intermediate point between a nose and a midpoint of said football, wherein said one end of said strap extends through an opening through said skin of said football at said intermediate point, and a loop formed at said one end of said strap wherein said loop extends around said bladder under said skin.

2. The football training device as defined in claim 1 wherein said strap is elastic.

3. The football training device as defined in claim 1 and comprising a handgrip formed at the other end of said strap.

4. The football training device as defined in claim 3 wherein said handgrip is adjustable in size.

5. The football training device as defined in claim 1 wherein said one end of said strap is attached to an inside area of said skin adjacent said opening.

6. The football training device as defined in claim 5 and comprising a grommet attached to said skin around said opening.

7. The football training device as defined in claim 5 wherein said one end of said strap is attached to said football skin by sewing through said one end of said strap and said skin.

* * * * *